United States Patent [19]

Bell

[11] Patent Number: 5,035,864

[45] Date of Patent: Jul. 30, 1991

[54] BLOOD CONTAINMENT DEVICE

[75] Inventor: Craig J. Bell, Winchester, N.H.

[73] Assignee: Smiths Industries Medical systems, Inc., Keene, N.H.

[21] Appl. No.: 470,944

[22] Filed: Jan. 26, 1990

Related U.S. Application Data

[63] Continuation-in-part of Ser. No. 190,498, May 5, 1988, abandoned.

[51] Int. Cl.[5] ..... B01L 11/00

[52] U.S. Cl. ..... 422/99; 422/56; 422/58; 422/61; 422/66; 422/102; 436/166; 436/169; 436/170; 435/311; 435/810

[58] Field of Search ..... 422/56, 66, 99, 102, 422/61, 58, 44, 28; 436/8, 16, 18, 44, 63, 80, 165, 166, 169, 176, 170; 435/292, 293, 311, 810

[56] References Cited

U.S. PATENT DOCUMENTS

| | | | |
|---|---|---|---|
| 3,216,804 | 11/1965 | Natelson | 422/66 X |
| 3,554,005 | 1/1971 | Koblin et al. | 422/66 X |
| 3,675,488 | 7/1972 | Viktora et al. | 422/66 X |
| 3,904,369 | 9/1975 | Adler et al. | 422/66 X |
| 4,071,315 | 1/1978 | Chateau | 422/66 X |
| 4,218,421 | 8/1980 | Mack, Jr. et al. | 422/102 X |
| 4,259,383 | 3/1981 | Eagensperger et al. | 422/28 X |
| 4,421,719 | 12/1983 | Burleigh | 422/66 X |

*Primary Examiner*—Robert J. Warden
*Assistant Examiner*—Lynn M. Kummert
*Attorney, Agent, or Firm*—Sewall P. Bronstein; Robert M. Asher

[57] ABSTRACT

A blood containment device including a housing with an opening through which an adhesive ply of multi-ply material is exposed. Blood is expelled from a syringe onto the exposed material. The housing has two chambers, one for the clean material and one for containing a take-up reel onto which the bvlood stained material is wound. A removable tension plate is supported within the housing to hold the absorbent material taut beneath the opening in the housing.

25 Claims, 3 Drawing Sheets

BLOOD CONTAINMENT DEVICE

CROSS-REFERENCE TO RELATED APPLICATIONS

This application is a continuation-in-part of Application Ser. No. 07/190,498, filed May 5, 1988, now abandoned.

BACKGROUND OF THE INVENTION

The present invention relates to a device and method for providing safe inspection and containment of blood expelled from a syringe.

In the procedure of blood gas analysis, there are several times when medical and laboratory personnel are exposed to blood. This blood is considered a biohazard because of its potential to contaminate hospital personnel with disease (hepatitis, AIDS, etc.).

In doing blood gas analysis in a laboratory, a common procedure called "topping off the sample" is performed with little regard to its hazardous implications. The phrase "topping off the sample" refers to the method of expelling blood from the blood gas sampling syringe onto a gauze. This is usually done just prior to injecting or aspirating blood to the blood gas machine or other analysis machines (co-oximitry, electrolytes, hematocrit, etc.). The reasons for doing this are to ensure that the analysis is run on blood from the body of the sample (less likely to be contaminated by ambient air) and to allow the lab technician to visually check for clots. A sample with clots is usually not run because the gas values are changing and clots can occlude the blood gas machine, resulting in machine down time.

There are several opportunities for hazardous exposure to blood when using the conventional method for "topping off the sample." First, there is a possibility of exposure during the open handling of the gauze and expelling of blood onto the gauze. Second, there is the possibility of contamination of the surface or table on which the gauze is placed. Third, the disposal of the gauze, usually into an open container, leaves a further danger of exposure.

The object of the present invention is to provide a safe and cost effective means for expelling blood from a syringe.

SUMMARY OF THE INVENTION

The present invention is directed to a blood containment device formed by a housing which contains a roll of multi-ply material. The multi-ply material includes an absorbent ply and a microbial resistant ply. The housing contains an opening which exposes a portion of the absorbent ply. A take-up reel is provided for winding up the used material past the opening.

The device of the present invention is further characterized by a removable tension plate. The plate includes standoffs which butt up against the top wall of the housing. A forked member is attached to the tension plate for holding the take-up reel down in its proper position.

The device is used by expelling blood from a syringe onto the material exposed through the opening in the housing. After inspecting the blood to determine if there are clots, the take-up reel is turned to pull the blood stained absorbent material past the opening. Thus, the blood is quickly and easily removed from potential contact with laboratory personnel.

Other objects and advantages of the present invention will become apparent from the following description taken in conjunction with the drawings.

DETAILED DESCRIPTION OF THE PREFERRED EMBODIMENT

Figure 1:
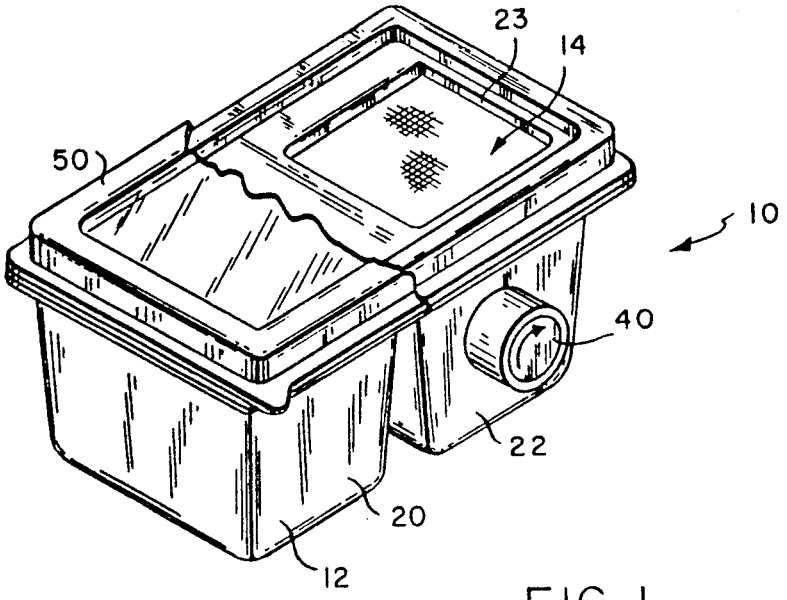
FIG. 1 is an isometric view with the lid broken away of the blood containment device of the present invention.

Referring now to the drawings, a blood containment device 10 is shown. The device 10 includes a housing 12 which may be formed from a material such as high impact polystyrene. The housing 12 may be in two parts. The bottom may be vacuum formed and later a top may be adhered onto it to form an enclosure. The top and bottom portions may be attached by solvent bonding, for example. The top wall of the housing includes an opening 23 through which a layer of material 14 is exposed. A lid 50 may be provided with the housing for enclosing the opening 23.

Figure 2:
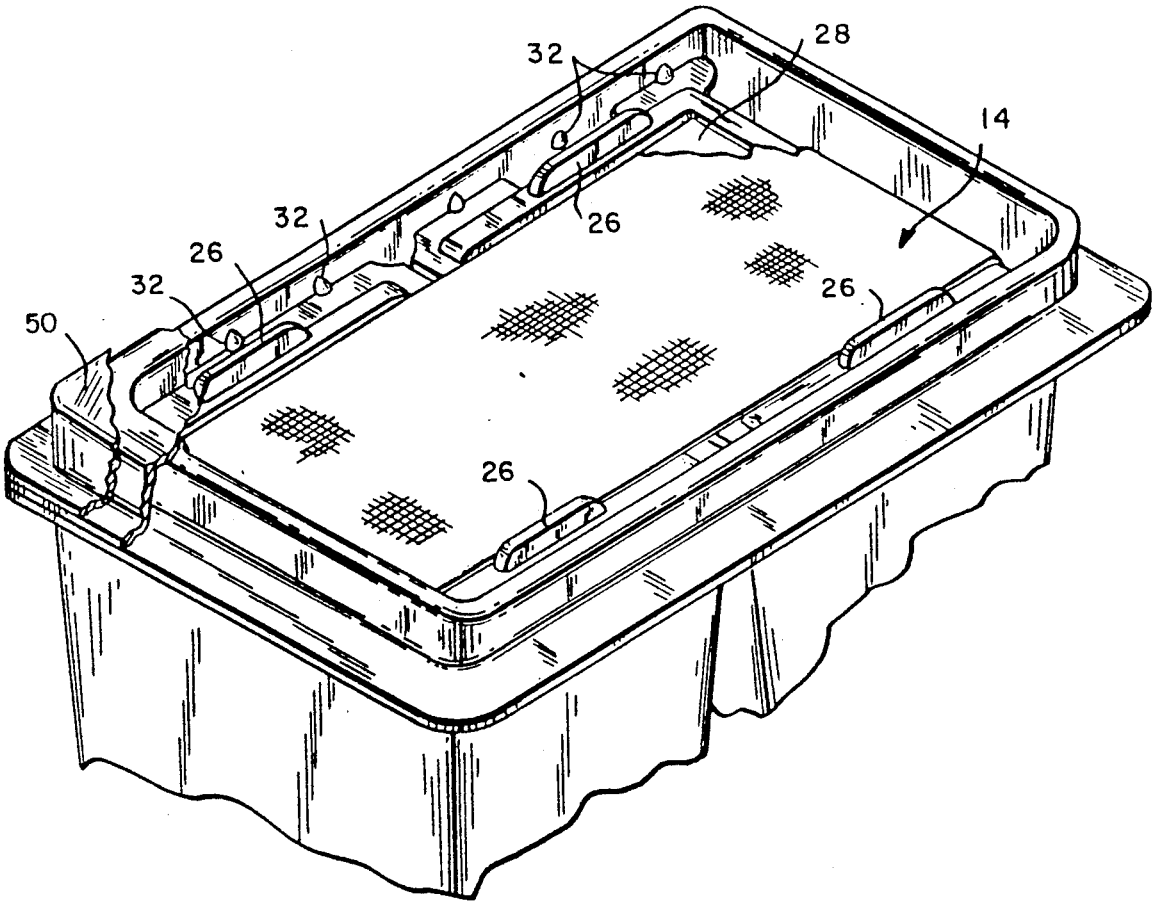
FIG. 2 is an enlargement of the blood containment device of FIG. 1 showing parts broken away.
Figure 3:
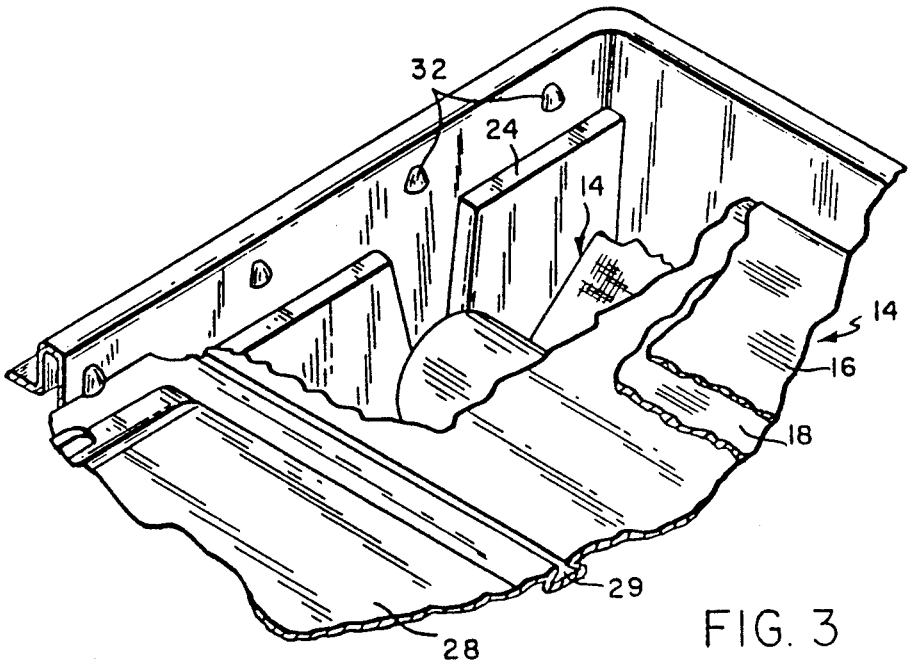
FIG. 3 is an enlargement of FIG. 2 with the tension plate broken away.
Figure 4:
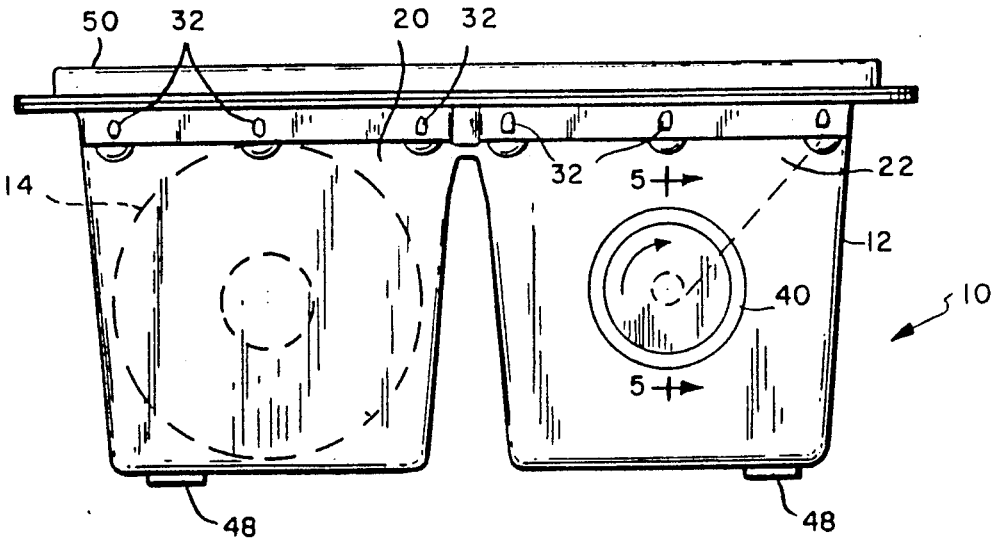
FIG. 4 is a front view of the blood containment device of FIG. 1.

The housing 12 is divided into two chambers. The first chamber 20, holds a roll of clean material 14 and the second chamber 22, holds the material after it has been stained with blood through the opening 23. As shown in FIG. 2, in accordance with the present invention, a removable tension plate 28 is positioned beneath the top wall of the housing 12. The tension plate 28 snaps into the housing 12 between a series of dimples 32 and a ledge 24. The ledge 24, shown in FIG. 3, is formed in the housing to support the tension plate 28. The dimples 32 are formed in the housing to help hold the tension plate 28 down. The tension plate has end portions which extend to the opposite end walls of the housing thereby preventing lateral movement. If a shorter tension plate is desired, a brace may be formed to extend from the middle portion of the housing to assist in discouraging lateral movement of the tension plate. The tension plate 28 forms a platform which supports the material proximate to the top wall of the housing. In addition, when the material is routed about the edges of the tension plate 28 and over its upper face, the tension plate acts as a tension drag, keeping the material taut when it is moved across the opening.

Figure 6:
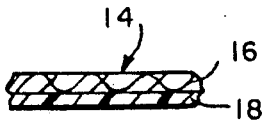
FIG. 6 is an enlargement of the two ply material.

The material 14 of the present invention is advantageously a multi-ply material. The preferred embodiment is a two ply material including an absorbent ply 16 and a microbial resistant ply 18. The individual plys are shown in FIGS. 3 and 6. The presently preferred absorbent ply 16 is a continuous layer of gauze or non-woven cellulose material The microbial resistant ply 18 may be a synthetic polymeric material such as polypropylene, polyethylene or vinyl. The absorbent ply may be impregnated with an antimicrobial agent, such as sulfadiazine, to immobilize active contaminates The microbial resistant ply acts to enclose the blood stained absorbent layer when it is rolled onto take-up reel 38. The two ply material can thus be advantageously used to inhibit the spread of microbial contamination within the housing 12.

Figure 5:
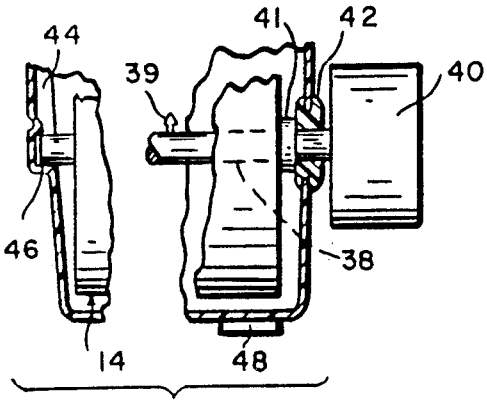
FIG. 5 is a sectional view along section line 5—5 of FIG. 4.

The chamber 22 for receiving the bloodstained material 14 includes a take-up reel 38. It is preferable that the opening 23 in the top wall of the housing be located over chamber 22 to minimize the distance the blood stained material must travel before entering the chamber One end of the two ply material 14 is secured to the take-up reel 38. The take-up reel 38 may be provided with a short spike 39 which can be used to pierce an end of the material to hold the material securely on the reel. As shown in FIG. 5, the take-up reel 38 has a widened portion 41 to prevent the reel from sliding out of the chamber. The take-up reel shaft is inserted from within the chamber through a hole filled with a sealing grommet 42. The widened portion 41 does not fit through the grommet 42. A handle 40 for turning the reel is then attached to the outer end of the shaft. At the end of the reel 38 inside the chamber 22, the chamber is formed with a well 44 to support the take-up reel. The well 44 may be formed with a yoke 46 into which the reel is snapped.

The device 10 may be provided with a pressure sensitive adhesive foam liner 48 on its bottom. This will permit the device to be stuck onto a table during use and prevent accidental spilling of the device. The adhesive should be such so as to permit the device to be lifted from the table and discarded after the roll of two ply material has been used up.

Figure 7:
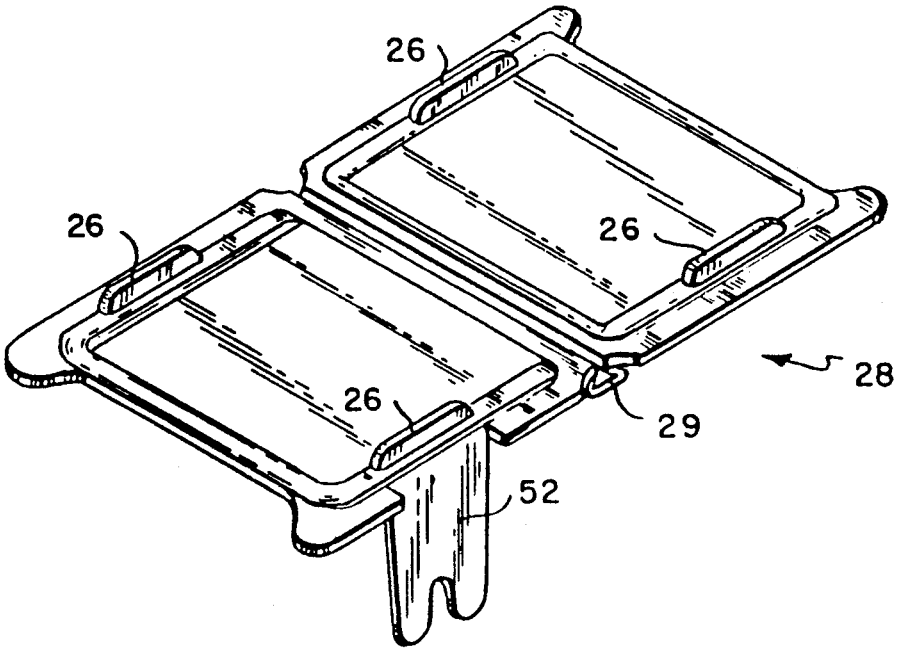
FIG. 7 is an isometric view of the tension plate and attachments.
Figure 8:
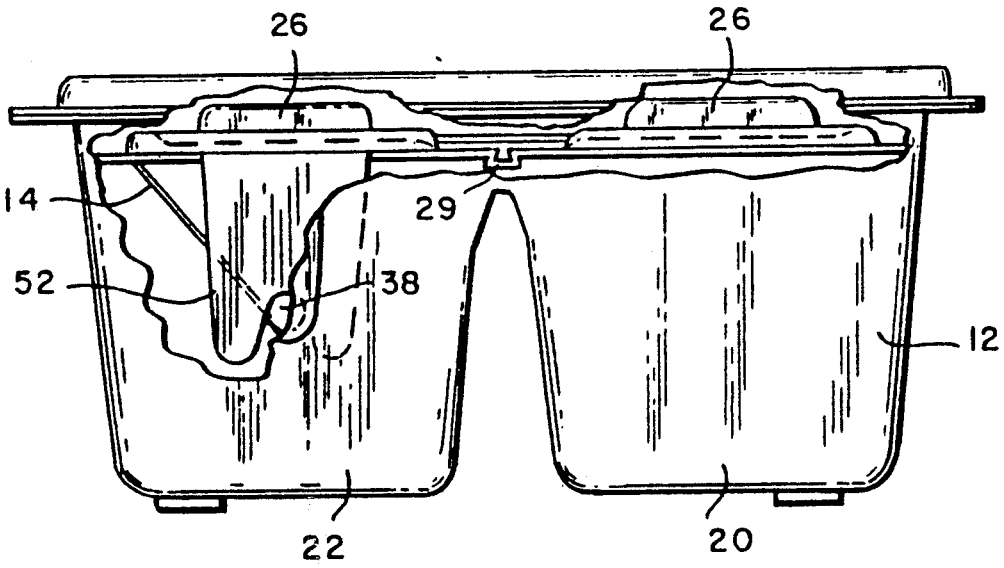
FIG. 8 is a rear view of the blood containment device of FIG. 1.

The removable tension plate 28 of the present invention is described in greater detail with respect to FIGS. 7 and 8. By making the tension plate non-integral with the housing 12, assembly of the blood containment device is made easier. The roll of material can be secured to the take-up reel 38. The take-up reel 38 is fit into position in chamber 22. One half of the tension plate is snapped into place beneath the dimples 32 over the take-up chamber 22 with the material 14 fed over the plate. The tension plate 28 is provided with a hinge 29 so that the portion of the plate over chamber 20 can be lifted up and the roll of material dropped into the chamber 20. This other half of the tension plate is then snapped into a flat position beneath the dimples 32. The top wall of the housing can then be adhered to the bottom portion.

Turning of the take-up reel 33 pulls the material 14 across the tension plate 28. This action has a tendency to cause the plate to buckle upwards. To prevent upward movement of the tension plate 28, standoffs 26 extend up from the tension plate 28. When the tension plate 28 is supported within the housing 12 by the ledge 24, the standoffs 26 extend so as to approach the top wall. Upward movement of the tension plate is prevented when the standoffs butt up against the top wall of the housing. The exact height of the standoffs is not critical They can extend so as to normally touch the top wall or they may be slightly lower which would permit some insignificant motion.

The end of the take-up reel 38 is also subject to being tugged upwards and out of the yoke 46. Advantageously, the tension plate 28 may be provided with a forked member 52 which is bent downwards to fit over the end of the take-up reel. The forked member 52 then catches the take-up reel in the well and prevents it from moving up out of position. It is well within the present invention to provide alternate means for holding the take-up reel down, such as using a brace separate from the tension plate.

The blood containment device 10 is used with the lid 50 lifted off. The device 10 may be secured to a table with the adhesive liners 48. Blood is expelled from a syringe onto the absorbent ply 16 of the material 14 exposed rough the opening 23. The blood may then be visually inspected to determine whether there is any clotting. After the inspection is completed, the handle 40 is turned to wind the blood stained material past the opening 23 and onto the take-up reel 38. An indicating line may be provided on the material to inform the user when the roll of material is almost used up. When the absorbent material has been fully used, the opening can be closed by snapping the lid 50 in place. The blood containment device 10 may then be lifted off from the table and discarded The blood containment device, thus, advantageously minimizes the risks of contact with the expelled blood.

Of course it should be understood that various changes and modifications to the preferred embodiment described above will be apparent to those skilled in the art. For example, many geometries may be selected for the housing and tension plate which would be equally suitable for carrying out the invention. Additionally, a simple gauze material could be substituted for material 14 and multiple tension plates may be substituted for the preferred single tension plate. These and other changes can be made without departing from the spirit and the scope of the invention and without diminishing its attendant advantages. It is therefore intended that such changes and modifications be covered by the following claims.

I claim:

1. A blood containment device comprising:

a housing having means defining an opening;

a roll of multi-ply material, including an absorbent ply and a microbial resistant ply, stored within said housing so that a portion of said absorbent ply is exposed through said opening;

a tension plate, non-integral with said housing, positioned to support said multi-ply material taut beneath the opening in said housing; and a take-up reel arranged within said housing so that said multi-ply material is pulled past the opening in said housing as said material is rolled onto said reel.

2. The blood containment device of claim 1 wherein said housing includes two chambers, one for said roll of multi-ply material and one for said take-up reel onto which said multi-ply material is wound.

3. The blood containment device of claim 2 wherein said tension plate comprises a hinge to permit a portion of said plate to be lifted from one of said chambers while the remainder of said plate is supported in position above the other of said two chambers.

4. The blood containment device of claim 1 wherein said housing includes means for supporting said tension plate beneath the opening in said housing.

5. The blood containment device of claim 4 further comprising means for holding said tension plate down to prevent said tension plate from buckling up toward said opening in said housing.

6. The blood containment device of claim 5 wherein said means for holding comprises dimples in said housing.

7. The blood containment device of claim 5 wherein said means for holding comprises standoffs extending up from said tension plate to butt against a top wall of said housing.

8. The blood containment device of claim 1 further comprising a well formed within said housing in which an end of said take-up reel is supported.

9. The blood containment device of claim 8 further comprising means for holding the end of said take-up reel within said well.

10. The blood containment device of claim 9 wherein said means for holding is attached of said tension plate.

11. The blood containment device of claim 11, wherein said microbial resistant ply comprises a synthetic polymeric material.

12. The blood containment device of claim 11, wherein said synthetic polymeric material comprises polypropylene.

13. The blood containment device of claim 1 wherein the absorbent ply is made of a non-woven cellulose material.

14. A disposable blood containment device comprising:

a housing having means defining an opening;

at least one tension plate non-integral with said housing;

means within said housing for supporting said at least one tension plate beneath the opening in said housing;

a roll of material stored within said housing, said material including an absorbent portion which is exposed through the opening in said housing;

means for winding said roll of material over said at least one tension plate past said opening.

15. The blood containment device of claim 14, wherein said roll of material includes an absorbent ply of a non-woven cellulose material.

16. The blood containment device of claim 15, wherein said absorbent ply is impregnated with an antimicrobial agent.

17. The blood containment device of claim 4 wherein said roll of material comprises a multi-ply material including a microbial resistant ply.

18. The blood containment device of claim 14, further comprising dimples formed within said housing to hold said at least one tension plate down beneath said opening.

19. The blood containment device of claim 14, wherein said means for supporting said at least one tension plate includes a ledge formed within said housing.

20. The blood containment device of claim 14 wherein said at least one tension plate comprises two halves connected by a hinge.

21. The blood containment device of claim 14 wherein said means for winding said material over said at least one tension plate past said opening includes a take-up reel.

22. The blood containment device of claim 21, further comprising a well formed within said housing for use in securing said take-up reel.

23. The blood containment device of claim 22 further comprising a forked member extending downward from said at least one tension plate to hold an end of said take-up reel within said well.

24. The blood containment device of claim 14 further comprising standoffs extending up from said at least one tension plate to butt against a top wall of said housing.

25. A disposable blood containment device comprising:

a housing which forms first and second chambers and has a top wall with means defining an opening therethrough;

a tension plate, non-integral with said housing having standoffs which butt against the top wall of said housing;

means within said housing for supporting said tension plate beneath the opening in said housing;

a roll of multi-ply material, including a continuous absorbent ply and a microbial resistant ply, stored within the first chamber of said housing;

a take-up reel in the second chamber of said housing, said roll of material being pulled over said tension plate and onto said take-up reel so that said multi-ply material is pulled past the opening in said housing with the absorbent ply exposed through said opening as said take-up reel is turned to roll said material onto said reel; and means, extending from said tension plate, for holding said take-up reel within said chamber.

* * * * *

UNITED STATES PATENT AND TRADEMARK OFFICE

CERTIFICATE OF CORRECTION

PATENT NO. : 5,035,864

DATED : July 30, 1991

INVENTOR(S) : Craig J. Bell

It is certified that error appears in the above-identified patent and that said Letters Patent is hereby corrected as shown below:

In the Abstract of the Disclosure

Line 2, please delete "adhesive" and insert --absorbent--.

Line 6, please delete "bvlood" and insert --blood--.

Signed and Sealed this

Nineteenth Day of January, 1993

*Attest:*

DOUGLAS B. COMER

*Attesting Officer*

*Acting Commissioner of Patents and Trademarks*